US005930457A

United States Patent [19]

Tourangeau

[11] Patent Number: 5,930,457

[45] Date of Patent: Jul. 27, 1999

[54] HEAT CELL FOR A ROOF

[75] Inventor: Donald R. Tourangeau, Wilsonville, Oreg.

[73] Assignee: Roof Ice Melt Systems, Inc., Wilsonville, Oreg.

[21] Appl. No.: 08/918,235

[22] Filed: Aug. 25, 1997

Related U.S. Application Data

[60] Provisional application No. 60/045,767, May 6, 1997.

[51] Int. Cl.[6] ..... F24D 19/02

[52] U.S. Cl. ..... 392/435; 219/535

[58] Field of Search ..... 392/435–438, 392/432; 219/213, 549, 535; 338/214

[56] References Cited

U.S. PATENT DOCUMENTS

| | | | |
|---|---|---|---|
| 2,111,251 | 3/1938 | Spilsbury . | |
| 2,507,039 | 5/1950 | Miller . | |
| 2,699,484 | 1/1955 | Michaels . | |
| 2,816,201 | 12/1957 | Mulvey | 392/432 |
| 3,119,918 | 1/1964 | Simon | 338/290 |
| 3,129,316 | 4/1964 | Glass et al. . | |
| 3,141,955 | 7/1964 | Culpepper . | |
| 3,303,324 | 2/1967 | Appleman | 219/213 |
| 3,388,738 | 6/1968 | Dery . | |
| 3,400,247 | 9/1968 | Deacon | 392/435 |
| 3,521,029 | 7/1970 | Toyooka et al. . | |
| 3,683,785 | 8/1972 | Grange . | |
| 3,691,343 | 9/1972 | Norman . | |
| 3,725,638 | 4/1973 | Solin et al. . | |
| 3,784,783 | 1/1974 | Gray . | |
| 3,821,512 | 6/1974 | Stanford . | |
| 3,842,241 | 10/1974 | Isaacson et al. | 392/435 |
| 3,939,616 | 2/1976 | Schapker . | |
| 4,043,527 | 8/1977 | Franzmeier . | |
| 4,081,657 | 3/1978 | Stanford . | |
| 4,110,597 | 8/1978 | Elmore . | |
| 4,134,002 | 1/1979 | Stanford | 219/213 |
| 4,308,696 | 1/1982 | Schroeder . | |
| 4,335,299 | 6/1982 | Belohlavek . | |
| 4,401,880 | 8/1983 | Eizenhoefer . | |
| 4,769,526 | 9/1988 | Taouil . | |
| 4,791,277 | 12/1988 | Montierth et al. | 219/535 |
| 4,880,051 | 11/1989 | Ohashi . | |
| 5,029,231 | 7/1991 | Carr et al. | 392/435 |
| 5,391,858 | 2/1995 | Tourangeau et al. . | |
| 5,531,543 | 7/1996 | Johnsen . | |
| 5,758,019 | 5/1998 | Klopotek | 392/432 |

FOREIGN PATENT DOCUMENTS

| | | | |
|---|---|---|---|
| 2807970 | 8/1979 | Germany | 392/435 |
| 4-31575 | 5/1990 | Japan . | |
| 390047 | 3/1933 | United Kingdom . | |
| 798206 | 7/1958 | United Kingdom | 392/435 |
| 971720 | 10/1964 | United Kingdom . | |

*Primary Examiner*—Teresa Walberg
*Assistant Examiner*—Quang Van
*Attorney, Agent, or Firm*—Kolisch Hartwell Dickinson McCormack & Heuser

[57] ABSTRACT

A heat cell is described including a lower panel which is placed on a roof and which is configured to form an open-side conduit. A heat-reflective layer is disposed adjacent the lower panel to direct heat upwardly, and a heat-generating mechanism is disposed in the conduit to provide heat to the cell. The heat-generating mechanism is sized to fit tightly inside the conduit. An upper panel snaps-on and attaches to the lower panel and encloses the heat-reflective layer and heat-generating mechanism.

13 Claims, 3 Drawing Sheets

HEAT CELL FOR A ROOF

CROSS-REFERENCE TO RELATED APPLICATIONS

This application springs from, is based upon, and claims the benefit under 35 U.S.C. § 119 of prior-filed U.S. Provisional Patent Application Ser. No. 60/045,767, entitled ROOF VALLEY ICE FORMATION PREVENTION SYSTEM, filed on May 6, 1997, incorporated herein by reference.

BACKGROUND OF THE INVENTION

This invention relates to an apparatus for melting frozen water off of a roof, and specifically to a system which will prevent or melt an ice dam formed on a roof valley, commonly found on commercial and residential roofs. Although the invention is described and illustrated herein in use on a roof valley, it is suitable for melting or preventing ice in a variety of other applications.

It is typical in many parts of the world that two to three feet of snow may build up on a roof surface and in the valleys. Roof valley ice formation occurs generally as result of melting snow that has accumulated on the surface of the roof. Water from the melting snow may freeze when the ambient temperature drops below freezing or when the water contacts a colder region of the roof valley. Under some circumstances, this freezing water may create ice dams which can be both dangerous and destructive.

One way in which ice dams form is on a roof which has inadequate insulation and is of what is referred to herein as single roof construction. Built-up snow is a good insulator and any heat loss from inside the building that reaches the exterior single roof surface melts a very thin layer of snow, forming a snow-water interface between the roof valley surface, which is often made of metal, and the lower surface of the snow. If the ambient temperature falls below freezing, the water will freeze and begin the formation of an ice dam. These ice dams may contain water and can cause interior leakage as the water finds its way underneath various types of exterior roofing material. Additionally, because the water and snow are retained on the roof, the weight build up can result in structural failure.

Such roof valley ice dams are, however, not limited to roofs which are not adequately insulated. A double roof, referred to as a cold roof, is built with a vented air space between the primary roof and an exterior roof. This is supposed to prevent any building heat loss from reaching the exterior surface of the roof and generally is effective in preventing melting at the bottom of the snow layer as the result of escaping heat. However, as the ambient temperature rises to near freezing (32° F.) the snow begins to melt along the roof peak, the water from the melting snow flows down the valleys and underneath the snow blanket, and ice formation occurs. Additionally, double or cold roofs are always vented at the roof peak to allow the warm air to escape from the air space between the two roof surfaces. This warm air aids in melting the snow at the peak and contributes to ice dam formation. Furthermore, snow accumulated on roof peaks is typically exposed to solar energy for longer periods than snow accumulated in roof valleys. Thus, snow on a roof peak is more likely to melt when the ambient temperature is near freezing than is snow in a valley below the peak.

Regardless of how valley ice formations occur, their presence can be extremely dangerous to passersby as they may be struck by falling ice and snow and seriously injured. Additionally, ice formation can result in serious damage to a building.

Most prior solutions to the problem of snow and ice accumulation on roofs have focused exclusively on roof eaves. Such a system is described in U.S. Pat. No. 5,391,858 entitled ICE DAM MELTING SYSTEM, the disclosure of which is incorporated herein by reference. Other solutions, while addressing the problem of roof valleys as well as roof eaves, are complex and difficult to assemble. For example, see U.S. Pat. No. 3,691,343 entitled MODULAR SYSTEM OF ROOF HEATER SHINGLES.

SUMMARY OF THE INVENTION

The invention provides a heat cell including a lower panel for placement on a roof. The lower panel includes at least one open-sided conduit. A heat-reflective insulation layer is disposed adjacent the lower panel to reflect the generated heat upward and to inhibit heat down-flow. A heat-generating mechanism is disposed in the conduit and is sized to fit tightly between the heat-reflective layer and the top lip of the conduit. A snap-on cap attaches to the lower panel and encloses the heat-reflective layer and heat-generating mechanism. The presence of this heat cell prevents the formation of ice or snow build up, and allows any water which is present as the result of melting ice or snow to run off the edge of the roof. An alternative embodiment of the invention involves installing two heat cells, one on each side of a roof valley, to prevent or remove ice or snow accumulation in the valley.

An object of the invention is to provide a heat cell which is easy to manufacture and assemble.

Another object of the invention is to provide a heat cell which effectively prevents the formation of ice or which will melt already-formed ice or accumulated snow on a roof.

An additional object of the invention is to provide a heat cell for a roof valley which may be easily installed, either as a retrofit or in new construction.

Another object of the invention is to provide a heat cell which can easily be shortened in the field to fit the application.

A further object of the invention is to provide a heat cell which is aesthetically pleasing and which will not be damaged by the presence of large amounts of snow and/or ice.

These and other objects and advantages of the invention will be more clearly understood from a consideration of the accompanying drawings and the following description of the preferred embodiment.

DETAILED DESCRIPTION OF THE PREFERRED EMBODIMENT

Figure 1:
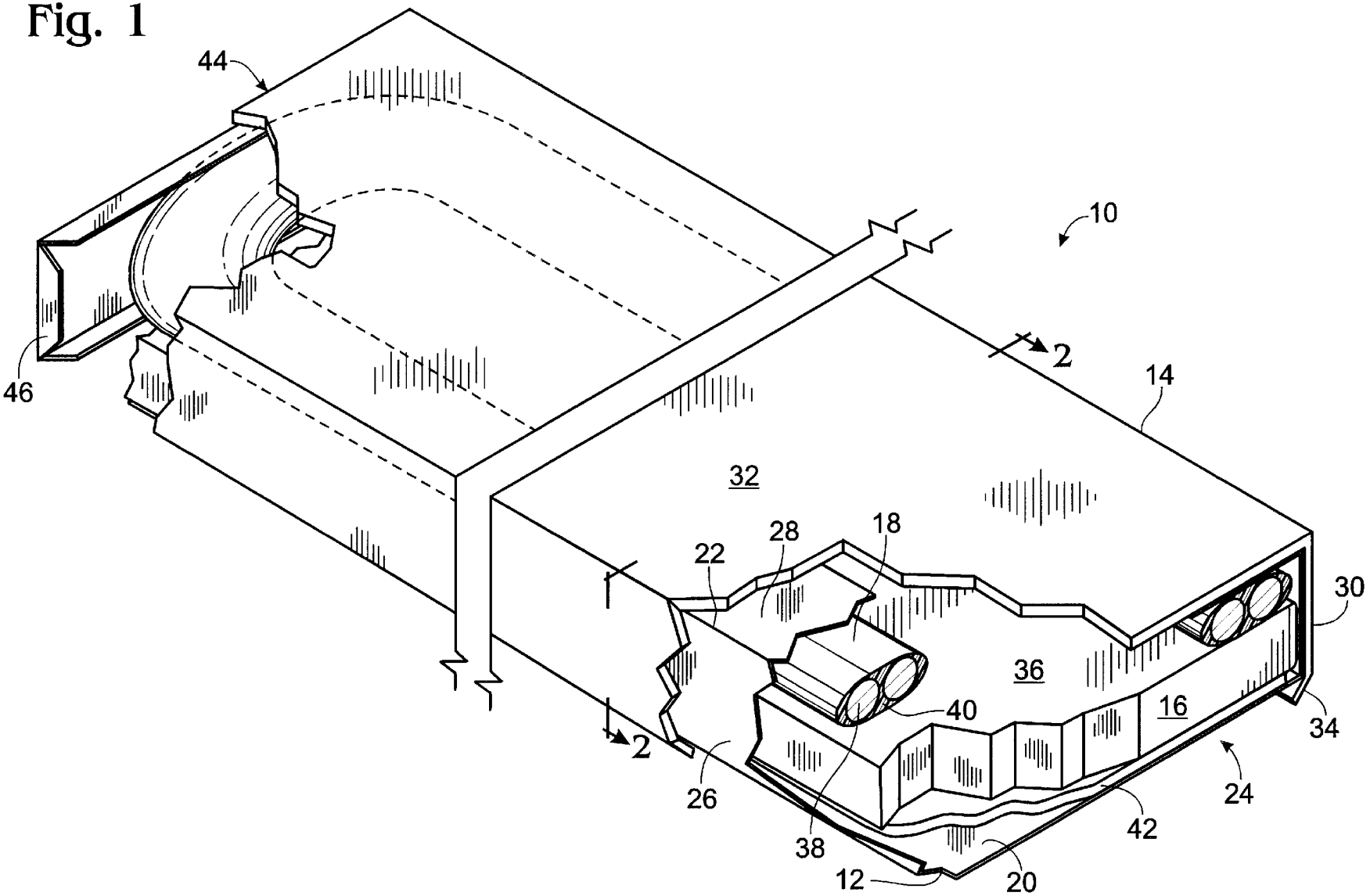
FIG. 1 is an isometric view of the preferred embodiment of a cell according to the present invention.

A heat cell for preventing the accumulation of snow or ice on roofs is shown in FIG. 1, indicated generally at 10. Selected aspects of heat cell 10 are also shown in the cross-sectional view of FIG. 2, so the reader may refer to that drawing as well while reading this description. Heat cell 10 includes a lower panel 12, an upper panel 14 attached to lower panel 12, a heat-reflective layer 16 disposed within lower panel 12, and a heat-generating mechanism 18 disposed adjacent heat-reflective layer 16.

According to the preferred embodiment, lower panel 12 is an elongate member for enclosing, supporting, and protecting a heat-generating mechanism 18. Lower panel 12 should be constructed of a suitable material for exposure to the varying environmental conditions of exterior use; preferably, a thin metal sheet such as 20 ounce Copper, or 40 mil Aluminum. Lower panel 12 should be configured for mounting on a roof, and especially on either side of a roof valley.

Lower panel 12 has a base 20 and an elongate edge 22 which is configured to form an open-sided, or C-shaped, conduit 24. Additionally, though not necessarily, lower panel 12 may have a second, opposing, elongate edge 22 such that base 20 extends between first and second edges 22. Similar to first edge 22, second edge 22 may be configured to form a second open-sided, or C-shaped, conduit 24 such that first and second conduits 24 are concave toward each other. Alternatively, conduit 24 is constructed separately and then connected to base 20, within the scope of the invention.

Edge 22 extends generally upwardly from base 20 to form side 26 of conduit 24. A portion of edge 22 extends generally inwardly from side 26 to form lip 28 of conduit 24. Thus, base 20, side 26, and lip 28 form an open-sided, or C-shaped, conduit 24. As can be seen most clearly in FIG. 2, the cross-sectional shape of lower panel 12, as viewed along the elongate axis, is generally rectilinear.

Although edge 22 of base 20 may be formed into conduit 24 in any manner, a particularly effective and efficient method of formation involves folding edge 22 to extend generally upwardly from base 20 to form side 26, and then further folding a portion of edge 22 to extend generally inwardly from side 26 to form lip 28 above base 20. While lower panel 12 is described as including one or two conduits 24, it will be appreciated that lower panel 12 may include three or more conduits 24.

Upper panel 14 is preferably, though not necessarily, an elongate member constructed of similar materials as lower panel 12. Upper panel 14 connects to lower panel 12 to enclose heat-reflective layer 16, heat-generating mechanism 18, and conduit 24. In the preferred embodiment, upper panel 14 includes two opposing arms 30 and a flat central region 32 therebetween. Arms 30 extend generally downwardly from central region 32 to wrap around sides 26 of conduit 24.

One advantage of the preferred embodiment is that upper panel 14 attaches to lower panel 12 in a snap-on fashion that allows easy assembly and disassembly. As seen most clearly in FIG. 2, the preferred embodiment of upper panel 14 includes flanges 34 which extend generally inwardly from aims 30 so that when upper panel 14 is connected to lower panel 12, flanges 34 extend below base 20 of lower panel 12 to snap-on and grip lower panel 12.

Preferably, upper panel 14 is sufficiently flexible such that arms 30 may be expanded from a nominal lateral dimension to extend around sides 26 and receive lower panel 12, and then return to the nominal lateral dimension to enclose and grip lower panel 12 in a snap-on fashion. While upper panel 14 is shown and described as extending around conduit 24 to grip base 20, it will be appreciated that upper panel 14 may additionally, or alternatively, be supported by, and grip conduit 24. In such a case, upper panel 14 may or may not wrap around sides 26 of conduit 24.

Referring back to FIG. 1, heat-reflective layer 16 may be constructed of any suitable material capable of withstanding and reflecting heat. Preferably, layer 16 is a resilient, thermal insulator with an upper, heat-reflecting surface 36. One insulator that has been found to work particularly well for this invention is a multi-layered, aluminum foil blanket with numerous air pockets formed between the layers of foil, manufactured by Reflectix Inc., Markleville Ind. This insulator is highly reflective, impervious to water, and of sufficient resilience and firmness to work properly with the preferred method of retaining heat-generating mechanism 18 within lower panel 12, as discussed in detail below.

Layer 16 is received into lower panel 12 and disposed adjacent base 20, with heat-reflecting surface 36 facing away from base 20. In the preferred embodiment layer 16 is sized to closely abut edges 22 and extend into conduit 24 between base 20 and lip 28. Additionally, heat-reflective layer 16 extends continuously between opposing edges 22 thus completely covering base 20 to intercept impinging heat and reflect it in an upward direction away from base 20.

Heat-generating mechanism 18 may be any suitable device which is capable of generating and radiating heat onto adjacent materials. The preferred embodiment employs a flexible, self-regulating, heat cable 18 having two 16 AWG nickel-plated copper wires 38. Wires 38 are embedded in parallel in a radiation cross-linked, self-regulating, conductive polymer core 40 specifically designed for melting snow and ice. A heat cable as described above, and shown in simplified form in FIGS. 1 and 2, is available from Thermon Manufacturing Co., San Marcos, Tex., and designated as RGS™ Self-Regulating Heating Cable. However, other suitable heat cables are readily available from various manufacturers.

Those skilled in the electrical arts will appreciate that one advantage of heat cable 18 described above, is that it may easily be cut to the desired length by the installer, and then either terminated or electrically connected in series to an adjacent heat cell 10. Furthermore, core 40 of heat cable 18 has a generally oval cross section which facilitates installation of heat cable 18 into conduit 24. In the preferred embodiment, heat cable 18 is received into lower panel 12 adjacent heat-reflective layer 16, and disposed in conduit 24 between lip 28 and heat-reflective layer 16, so that heat which is generated by the cable is reflected upwardly away from base 12.

Figure 2:
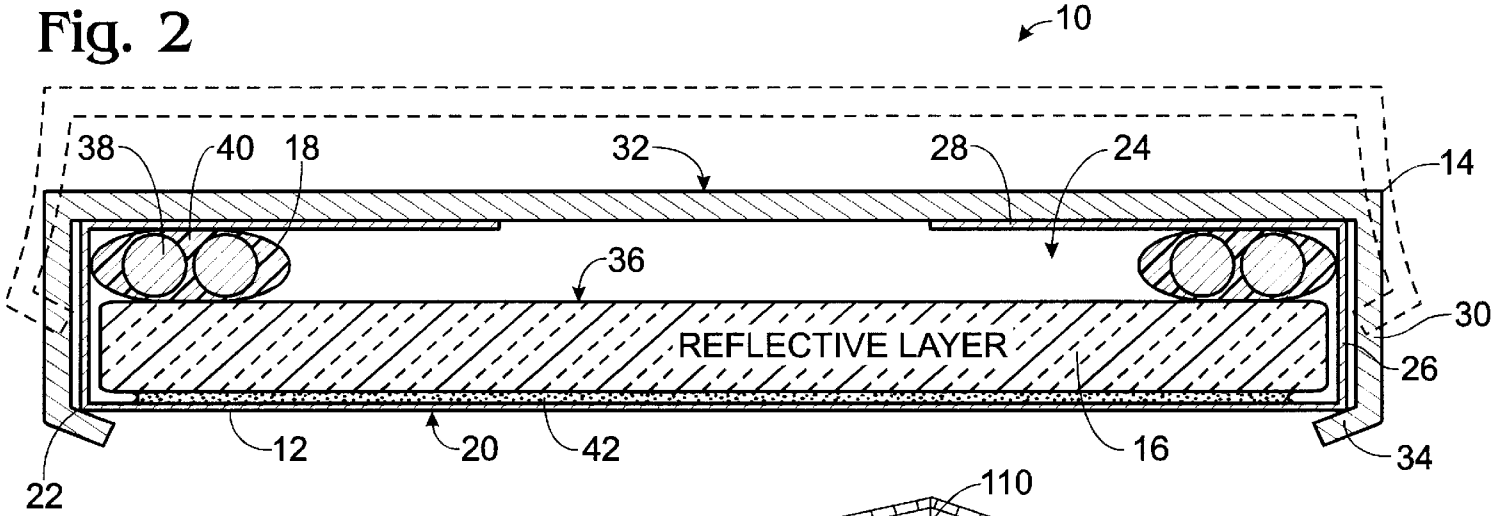
FIG. 2 is a cross-sectional view of the heat cell of FIG. 1, taken substantially along line 2—2 in FIG. 1, and shown on a larger scale than in FIG. 1.

The cross-sectional view of FIG. 2 shows an important feature of the preferred embodiment. The reader will note that conduit 24, heat-reflective layer 16, and heat-generating mechanism 18 are dimensioned, in relation to each other, so that mechanism 18 fits tightly within conduit 24 and is held between layer 16 and lip 28. If heat-reflective layer 16 is not used, conduit 24 and heat-generating mechanism 18 are dimensioned to create a tight fit between heat-generating mechanism 18 and conduit 24.

Figure 4:
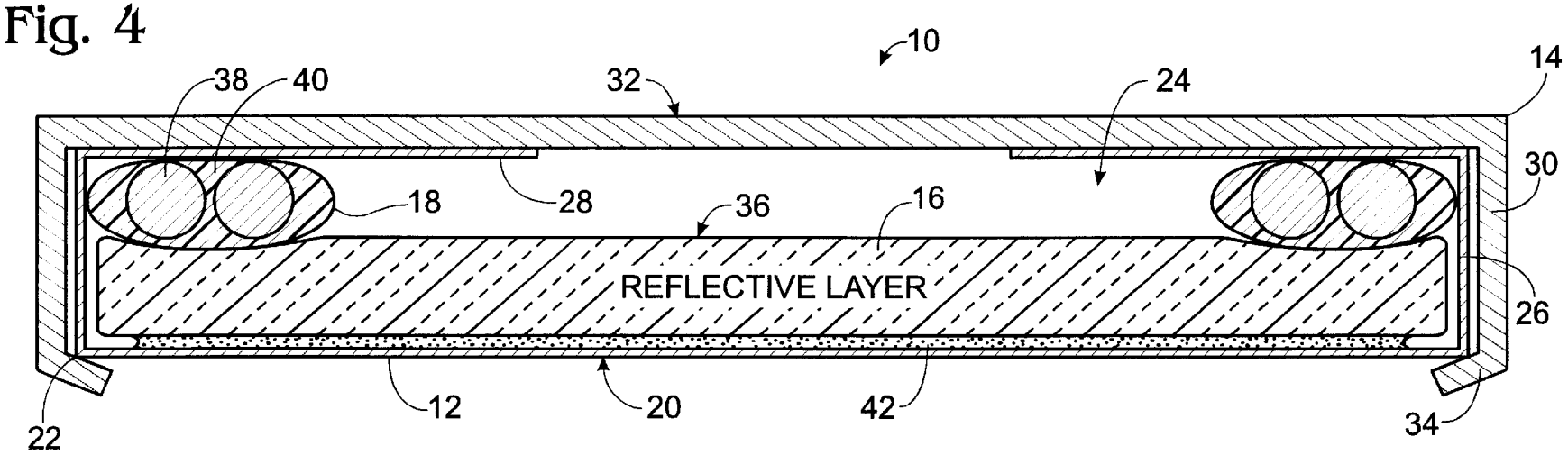
FIG. 4 is a cross-sectional view of an alternative embodiment of the invented heat cell, illustrating a tight fit of the heat-generating mechanism in the conduit, which compresses the heat-generating mechanism and the reflective layer.
Figure 5:
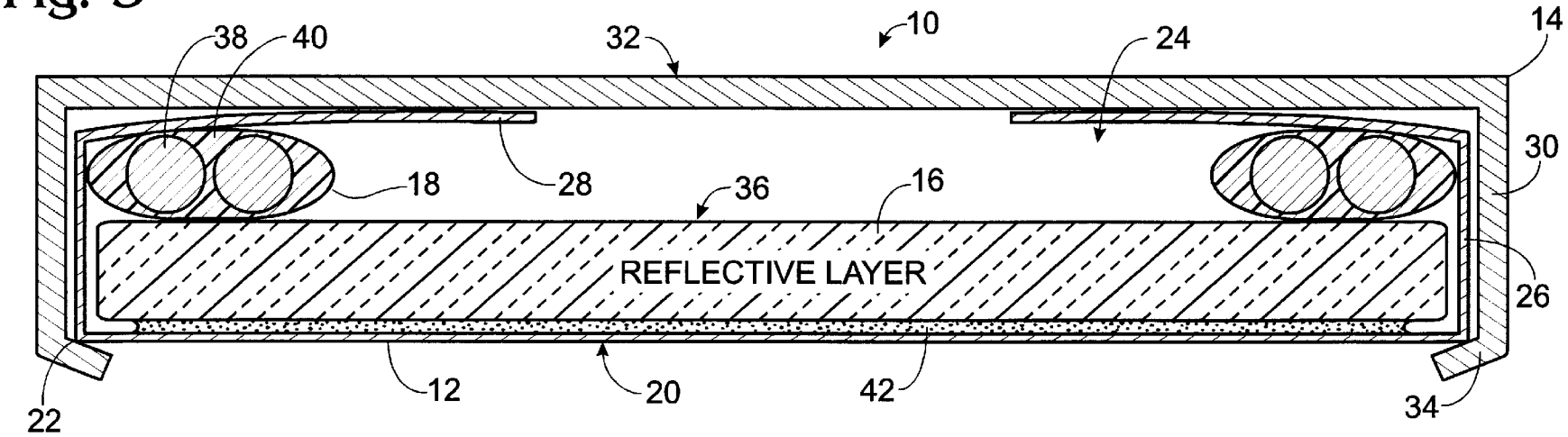
FIG. 5 is a cross-sectional view of an alternative embodiment of the invented heat cell, illustrating flexible expansion of the conduit due to a tight fit of the heat-generating mechanism within the conduit.

As shown in FIG. 4, this tight fit of heat-generating mechanism 18 may cause mechanism 18, or layer 16 (if used), or both, to be slightly compressed. Alternatively, or additionally, the tight fit may cause conduit 24 to flexibly expand by raising lip 28 in an upward direction away from base 20, as shown in FIG. 5. In either case, the tight fit ensures that mechanism 18 will be retained in conduit 24 without additional attachment or securing means, while still allowing mechanism 18 to be easily installed in conduit 24 by pressing mechanism 18 through the open side of conduit 24.

Locating heat-generating mechanism 18 between heat-reflective layer 16 and lip 28 ensures that the heat generated by mechanism 18 is radiated onto adjacent edges 22, as well as onto layer 16 which intercepts the heat and reflects it in a direction away from layer 16. More specifically, the heat generated by mechanism 18 and reflected by layer 16 is directed upwardly to be received by upper panel 14 which, through thermal conduction, transfers the heat to any snow or ice that may be located adjacent upper panel 14.

Also, in the preferred embodiment, an adhesive 42 is placed between heat-reflective layer 16 and base 20 of lower panel 12, adhesively to attach layer 16 to base 20. Preferably, adhesive 42 should be selected to withstand temperatures from well below freezing (32° F.) to well above the maximum external summer temperature of the geographical region where the heat cell is to be installed. The construction adhesive "Vulkem 116" is used in the preferred embodiment. Vulkem is manufactured by Mameco International, Cleveland, Ohio.

Referring once again to FIG. 1, the preferred embodiment of lower panel 12 includes opposing ends 44 adjacent elongate edges 22. Ends 44 are preferably open to facilitate insertion therein of heat-reflective layer 16 and heat-generating mechanism 18. While layer 16 and mechanism 18 are typically weather-proof, one or two endcaps 46 may be connected to lower panel 12 to prevent water or debris from entering lower panel 12. Endcaps 46 have the further purpose of making heat cell 10 more aesthetically pleasing. In the preferred embodiment, endcap 46 is configured to fit over end 44 of lower panel 12 and extend between sides 26, while being received within a portion of upper panel 14. Typically, though not necessarily, endcap 46 is constructed of the same material as lower panel 12. In addition, endcap 46 may include a third open-sided, or C-shaped, conduit 24 in which a portion of heat-generating mechanism 18 is disposed.

Those skilled in the art will appreciate that one of the advantages of heat cell 10, as described herein, is the ease with which it may be assembled. Indeed, assembly of the preferred embodiment requires no tools whatsoever, with the possible exception of an adhesive applicator. However, a further advantage of heat cell 10 is that it may be easily shortened in the field to fit the installer's needs.

To shorten heat cell 10, the installer simply snaps upper panel 14 off of lower panel 12, removes endcap 46 from one end of lower panel 12, and then removes heat cable 18 from the same end of lower panel 12. Next, using a suitable tool such as a hacksaw, the installer cuts the desired amount from the end of lower panel 12 where heat cable 18 was removed. If heat-reflective layer 16 is used, the installer should leave it in lower panel 12 so that it will be cut at the same time that lower panel 12 is cut. Similarly, the installer simply cuts the same amount from upper panel 14. Having shortened both lower panel 12 and upper panel 14, the installer then cuts heat cable 18 to the desired length as discussed above. Finally, the installer reassembles heat cell 10 by pushing the removed portion of heat cable 18 back into conduits 24, attaching endcap 46 to the end 44 of lower panel 12 which was cut, and finally, snapping upper panel 14 onto lower panel 12.

Figure 3:
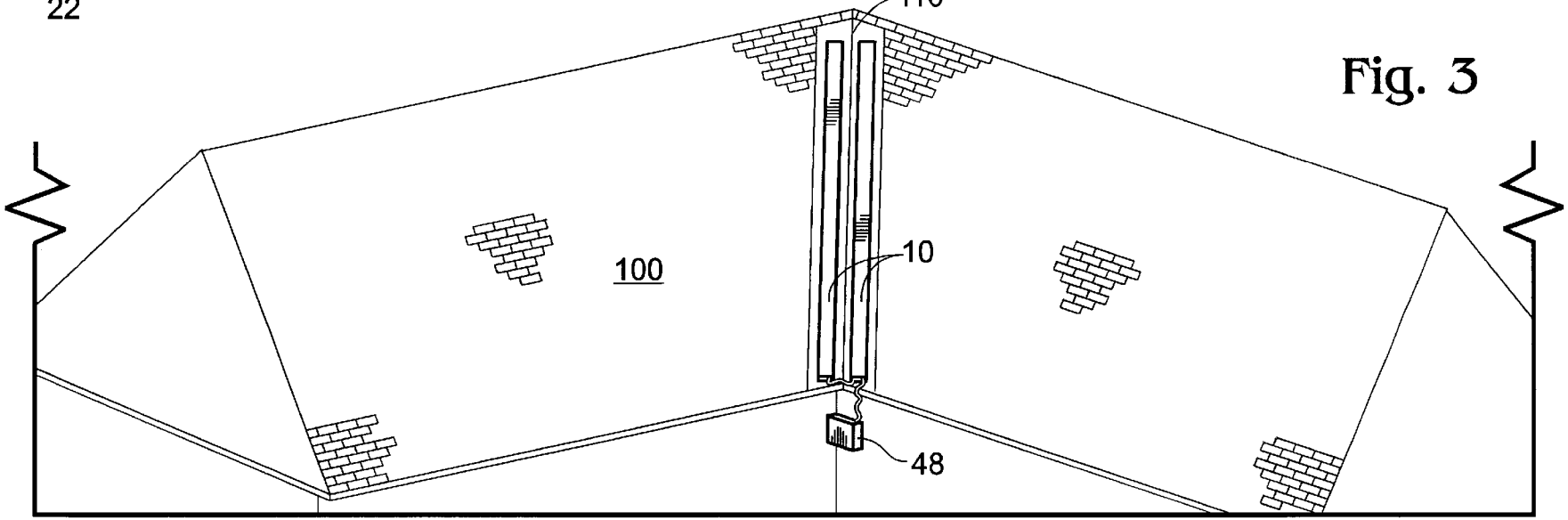
FIG. 3 is a fragmentary perspective view showing two heat cells similar to the heat cell shown in FIG. 1, shown installed on either side of a roof valley.

Turning now to FIG. 3, the invention is shown in use. In the preferred embodiment, heat cable 18 is operatively connected to an external power supply 48 to provide electrical energy to heat cable 18. Preferably, heat cable 18 is designed to operate on a selected line voltage of either 120, 208, 240, or 277 VAC without the use of a transformer. In addition, those skilled in the electrical ails will appreciate that a wide variety of control means may be operatively connected to heat cell 10 in order to automatically or manually control the periods during which heat cell 10 operates, thus conserving energy and prolonging the life of heat-generating mechanism 18.

Also shown in FIG. 3 is a roof 100 and a roof valley 110. Two heat cells 10 are usually installed, one for each side of roof valley 110, and may be pre-painted to match the surrounding structure. Heat cell 10 operates by conducting heat, which is generated by heat-generating mechanism 18, through upper panel 14 and onto snow or ice which may be located in roof valley 110 adjacent upper panel 14.

While many methods of installing heat cell 10 on roof 100 are available, a method which does not require penetration of roof 10 is preferable. One such method includes applying a suitable caulking material between heat cell 10 and roof 100. In the preferred embodiment, the construction adhesive "Vulkem 116," which is used to attach heat-reflective layer 16 to base 20, is also used to attach heat cell 10 to roof 100. Although FIG. 3 shows the invention in use on a roof valley, those skilled in the art will readily appreciate that the invention is well suited for use on other areas of a roof as well as on structures other than roofs, such as walls. In this respect, reference in the claims to a "lower panel" or "upper panel" is for the purpose of clarification of the difference between lower panel 12 and upper panel 14, and is not intended to mean that panel 10 must be installed in any particular orientation relative to "up" and "down."

While the present invention has been shown and described by reference to preferred embodiments, it will be apparent to those skilled in the art that other changes in form and detail may be made therein without departing from the spirit and scope of the invention defined in the appended claims.

I claim:

1. A heat cell comprising:

a lower panel including a flexible, open-sided conduit;

a heat-reflective layer received into the lower panel; and a heat-generating mechanism disposed in the conduit and adjacent the heat-reflective layer, and wherein the conduit, the heat-reflective layer, and the heat-generating mechanism are dimensioned such that the heat-generating mechanism fits tightly within the conduit.

2. The heat cell of claim 1 further comprising a snap-on upper panel.

3. The heat cell of 2 wherein the upper panel includes downwardly extending arms which wrap around the conduit, and inwardly extending flanges which grip the lower panel.

4. The heat cell of claim 1 wherein the heat-generating mechanism is a heat cable.

5. The heat cell of claim 1 wherein the heat-reflective layer is adhesively attached to the lower panel.

6. The heat cell of claim 1 wherein the tight fit of the heat-generating mechanism in the conduit causes the heat-generating mechanism, or the heat-reflective layer, or both to be compressed.

7. A heat cell comprising:

a lower panel including an open-sided conduit;

a heat-reflective layer received into the lower panel; and a heat-generating mechanism disposed in the conduit and adjacent the heat-reflective layer, and wherein the conduit, the heat-reflective layer, and the heat-generating mechanism are dimensioned such that the heat-generating mechanism fits tightly within the conduit, and wherein the conduit is flexibly expanded due to the tight fit of the heat-generating mechanism.

8. A heat cell comprising:

an elongate lower panel having a base and two elongate, C-shaped edges, where the C-shaped edges are concave toward each other;

an elongate upper panel snapped on and attached to the lower panel and enclosing the base and the edges;

a heat-reflective layer disposed adjacent the base; and a heat-generating mechanism disposed within the C-shaped edges and adjacent the reflective layer, and where the C-shaped edges, the heat-reflective layer, and the heat-generating mechanism are dimensioned such that the heat-generating mechanism is tightly held between the reflective layer and the C-shaped edges.

9. The heat cell of claim 8 wherein the heat-generating mechanism is a heat cable.

10. The heat cell of claim 8 wherein the heat-reflective layer is adhesively attached to the lower panel.

11. The heat cell of claim 8 wherein the upper panel includes flanges extending generally inwardly which grip the lower panel.

12. The heat cell of claim 8 further comprising a power supply operatively connected to the heat-generating mechanism.

13. The heat cell of claim 8 further comprising an endcap connected to the lower panel.

* * * * *